US007468232B2

(12) United States Patent
Bayley et al.

(10) Patent No.: US 7,468,232 B2
(45) Date of Patent: Dec. 23, 2008

(54) PROCESSES FOR FORMING LATEXES AND TONERS, AND LATEXES AND TONER FORMED THEREBY

(75) Inventors: Robert D. Bayley, Fairport, NY (US); Maura A. Sweeney, Rochester, NY (US); Grazyna Kmiecik-Lawrynowicz, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 577 days.

(21) Appl. No.: 11/115,189

(22) Filed: Apr. 27, 2005

(65) Prior Publication Data

US 2006/0246366 A1 Nov. 2, 2006

(51) Int. Cl.
*G03G 9/00* (2006.01)

(52) U.S. Cl. ..... 430/105; 430/108.1; 430/137.14

(58) Field of Classification Search ..... 430/105, 430/108.1, 137.14; 524/458
See application file for complete search history.

(56) References Cited

U.S. PATENT DOCUMENTS

| | | | |
|---|---|---|---|
| 3,590,000 | A | 6/1971 | Palermiti et al. |
| 3,655,374 | A | 4/1972 | Palermiti et al. |
| 3,674,736 | A | 7/1972 | Lerman et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,265,660 | A | 5/1981 | Giflo |
| 4,394,430 | A | 7/1983 | Jadwin et al. |
| 4,558,108 | A | 12/1985 | Alexandru et al. |
| 4,560,635 | A | 12/1985 | Hoffend et al. |
| 4,563,408 | A | 1/1986 | Lin et al. |
| 4,584,253 | A | 4/1986 | Lin et al. |
| 4,585,884 | A | 4/1986 | Lin et al. |
| 4,797,339 | A | 1/1989 | Maruyama et al. |
| 4,837,100 | A | 6/1989 | Murofushi et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,002,846 | A | 3/1991 | Creatura et al. |
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,593,807 | A | 1/1997 | Sacripante et al. |
| 5,604,076 | A | 2/1997 | Patel et al. |
| 5,648,193 | A | 7/1997 | Patel et al. |
| 5,650,255 | A | 7/1997 | Ng et al. |
| 5,650,256 | A | 7/1997 | Veregin et al. |
| 5,658,704 | A | 8/1997 | Patel et al. |
| 5,660,965 | A | 8/1997 | Mychajlowskij et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,843,614 | A | 12/1998 | Shinzo et al. |
| 5,853,944 | A | 12/1998 | Foucher et al. |
| 5,858,601 | A | 1/1999 | Ong et al. |
| 5,863,698 | A | 1/1999 | Patel et al. |
| 5,869,215 | A | 2/1999 | Patel et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,928,829 | A | 7/1999 | Cheng et al. |
| 5,977,210 | A | 11/1999 | Patel et al. |
| 6,162,241 | A * | 12/2000 | Coury et al. ..... 606/214 |
| 6,475,691 | B1 | 11/2002 | Cheng et al. |
| 2005/0186288 | A1 * | 8/2005 | Chiou et al. ..... 424/617 |
| 2005/0226661 | A1 * | 10/2005 | Ohmura et al. ..... 399/333 |
| 2006/0147716 | A1 * | 7/2006 | Braverman et al. ..... 428/411.1 |

* cited by examiner

*Primary Examiner*—Mark F Huff
*Assistant Examiner*—Rachel L Burney
(74) *Attorney, Agent, or Firm*—Oliff & Berridge, PLC

(57) ABSTRACT

A process for preparing a latex includes polymerizing at least one monomer in the presence of an initiator to form a polymer emulsion; and adding an odor-scavenging bismuth compound to the formed polymer emulsion.

15 Claims, No Drawings

PROCESSES FOR FORMING LATEXES AND TONERS, AND LATEXES AND TONER FORMED THEREBY

BACKGROUND

The present disclosure relates to processes for the preparation of a latex by, for example, the emulsion polymerization of monomer in the presence of an odor-reducing compound such as bismuth subsalicylate, as well as to latex and toner compositions formed thereby.

The present disclosure is generally directed to latex and toner processes, and more specifically to processes that utilize emulsion polymerization to form a latex and aggregation and coalescence or fusion of the latex, colorant, such as pigment, dye, or mixtures thereof, and optional additive particles to form a final composition such as a toner composition. In embodiments, the present disclosure is directed to latex emulsion processes and aggregation and coalescence processes with colorant particles, and wherein an odor scavenging additive is used to remove odor-causing species. The latex can in turn be used for forming a toner composition, in a subsequent aggregation or coalescence process. The resulting toners can be selected for known electrophotographic imaging and printing processes, including digital color processes, and more specifically these toners are especially useful for imaging processes, especially xerographic processes.

In imaging systems, especially color systems, small sized toners of, for example, from about 2 to about 8 microns can be of value for the achievement of high image quality for process color applications. It is also important to have a low image pile height to eliminate, or minimize image feel and avoid paper curling after fusing. Paper curling can be particularly pronounced in xerographic color processes primarily because of the presence of relatively high toner coverage as a result of the application of three to four color toners. During fusing, moisture escapes from the paper due to high fusing temperatures of from about 120° C. to about 200° C. In the situation wherein only one layer of toner is selected, such as in one-color black or highlight color xerographic applications, the amount of moisture driven off during fusing can be reabsorbed by the paper, and the resulting print remains relatively flat with minimal paper curl. In process color where toner coverage is high, the relatively thick toner plastic covering on the paper can inhibit the paper from reabsorbing the moisture, and cause substantial paper curling. These and other imaging shortfalls and problems are avoided or minimized with the toners and processes featured herein.

Also, it may be useful to select certain toner particle sizes, such as from about 2 to about 12 microns, with a high colorant, especially pigment loading, such as from about 4 to about 17 percent by weight of toner, so that the mass of toner necessary for attaining the required optical density and color gamut can be significantly reduced to eliminate or minimize paper curl. Lower toner mass also ensures the achievement of image uniformity. However, higher pigment loadings often adversely affect the charging behavior of toners. For example, the charge levels may be too low for proper toner development or the charge distributions may be too wide and toners of wrong charge polarity may be present. Furthermore, higher pigment loadings may also result in the sensitivity of charging behavior to charges in environmental conditions, such as temperature and humidity. Toners prepared in accordance with the processes featured herein minimize, or avoid a number of these disadvantages.

There is illustrated in U.S. Pat. No. 4,996,127, the disclosure of which is totally incorporated herein by reference, a toner of associated particles of secondary particles comprising primary particles of a polymer having acidic or basic polar groups and a coloring agent. The polymers selected for the toners can be prepared by an emulsion polymerization method. It is indicated that the toner can be prepared by mixing the required amount of coloring agent and optional charge additive with an emulsion of the polymer having an acidic or basic polar group obtained by emulsion polymerization.

In U.S. Pat. No. 4,983,488, the disclosure of which is totally incorporated herein by reference, there is disclosed a process for the preparation of toners by the polymerization of a polymerizable monomer dispersed by emulsification in the presence of a colorant and/or a magnetic powder to prepare a principal resin component, and then effecting coagulation of the resulting polymerization liquid in such a manner that the particles in the liquid after coagulation have diameters suitable for a toner. In U.S. Pat. No. 4,797,339, the disclosure of which is totally incorporated herein by reference, there is disclosed a process for the preparation of toners by resin emulsion polymerization wherein certain polar resins are selected; and in U.S. Pat. No. 4,558,108, the disclosure of which is totally incorporated herein by reference, there is disclosed a process for the preparation of a copolymer of styrene and butadiene by specific suspension polymerization.

Polyester based chemical toners substantially free of encapsulation are also known, reference U.S. Pat. No. 5,593,807, the disclosure of which is totally incorporated herein by reference, wherein there is disclosed a process for the preparation of a toner comprised of a sodio sulfonated polyester resin and pigment, and wherein the aggregation and coalescence of resin particles is mediated with an alkali halide. Other U.S. patents that may be of interest, the disclosures of which are totally incorporated herein by reference, are U.S. Pat. Nos. 5,853,944; 5,843,614; 5,840,462; 5,604,076; 5,648,193; 5,658,704; and 5,660,965.

In U.S. Pat. No. 4,837,100, the disclosure of which is totally incorporated herein by reference, there is illustrated, for example, an electrophotographic developer comprising a carrier, toner particles positively chargeable by friction with the carrier, fine particles of hydrophilic alumina, and fine particles of one of tin oxide, hydrophobic silica and titanium dioxide, and wherein the hydrophilic alumina fine particles are present in an amount of from about 0.1 to about 3 percent by weight based on the weight of toner particles. The alumina particles of this patent can be selected for the toners and processes featured herein in embodiments thereof.

Emulsion/aggregation/coalescence processes for the preparation of toners are illustrated in a number of Xerox Corporation patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797; and also of interest may be U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; 5,858,601, and 5,977,210. The appropriate components and processes of the above Xerox Corporation patents can be selected for the processes featured herein in embodiments thereof.

Despite these various processes for forming latexes and toners, a problem remains in the final compositions. In particular, many of the final compositions exhibit undesirable odors. For example, when many toner compositions are fused to a print medium, i.e., when the toner composition is heated to cause fusing, the toner compositions emit a strong, undesirable odor. Such odors may be caused by the emission of volatile organic and/or sulfur-containing compounds, which are predominantly present in the toner composition as originating in the latex used to form the composition. Such odors can also be noticed in the toner compositions at room temperature, such as during processing, toner composition replacement, and the like. While not adversely affecting print quality, these odors are undesirable to many production personnel and end-use customers. Many attempts have been made to address this odor issue, although with varying effect.

For example, U.S. Pat. No. 5,928,829 discloses toner processes where a latex is formed by polymerization of monomer in the presence of a catalytic chain transfer component and an initiator. The process is described to provide latex compositions that are free of solvents, and which thus exhibit decreased or minimal odor.

U.S. Pat. No. 6,475,691 also discloses processes for the preparation of toner involving (i) aggregating a colorant dispersion containing a suitable surfactant with a latex emulsion containing an anionic surfactant, a nonionic surfactant, and a water miscible chain transfer agent, or a nonionic surfactant with chain transfer characteristics to form toner sized aggregates; (ii) coalescing or fusing said aggregates; and optionally (iii) isolating, washing, and drying the resulting toner. The patent describes that the use of the chain transfer agent helps to reduce odor by avoiding the use of costly and hazardous odor producing components, such as carbon tetrabromide, alkyl thiols such as butanethiol and octanethiol, and the like.

SUMMARY

Despite the various attempts to provide latex and toner compositions with reduced odor, a need remains in the art for low-odor compositions. The need likewise remains for processes for producing such latex and toner compositions, where odor-causing compounds are removed in an efficient and effective manner.

It is a feature of the present disclosure to provide toner processes with many of the advantages illustrated herein.

In another feature of the present disclosure there are provided simple and economical processes for the preparation of latexes, and black and colored toner compositions with excellent colorant, especially pigment dispersions, thus enabling the achievement of excellent color print quality.

In a further feature of the present disclosure there is provided a process for the preparation of reduced odor emulsions and toner compositions thereof with a volume average diameter of from between about 1 to about 20 microns, and preferably from about 2 to about 12 microns, and a particle size distribution of about 1.10 to about 1.35, and preferably from about 1.15 to about 1.25 as measured by a Coulter Counter.

In a further feature of the present disclosure there is provided a process for the preparation of toner by aggregation and coalescence or fusion (aggregation/coalescence) of latex, pigment, and additive particles, and wherein the latex exhibits reduced odor by the removal of odor-causing species as illustrated herein.

These and other features of the present disclosure are accomplished in embodiments by the provision of latexes, toners and processes thereof. In embodiments, there are provided processes for the preparation of low odor latexes, and toner compositions thereof by the aggregation/coalescence of latex and colorant, especially pigment particles, and wherein the temperature of the aggregation may be selected to control the aggregate size, and thus the final toner particle size, and the coalescence temperature and time may be utilized to control the toner shape and surface properties.

In particular, the present disclosure provides a process for the preparation of a latex comprising polymerizing at least one monomer in the presence of an initiator and synthesizing to completion. An amount of the odor-scavenging compound is added to the cooled polymer for a time period then removed by filtration. The odor-scavenging compound can be, for example, a bismuth compound such as bismuth subsalicylate.

The present disclosure also provides latexes, toners, and developers produced by such a method.

DETAILED DESCRIPTION OF PREFERRED EMBODIMENTS

The present disclosure relates to a process for the preparation of a latex comprising the polymerization of monomer, an optional chain transfer component, an initiator, and an optional nonionic surfactant. Once the polymerization is completed, an odor scavenging compound is added and subsequently filtered out to remove odor causing species from the formed latex.

According to embodiments, the compound that scavenges odor-causing species is preferably any compound that is capable of scavenging such odor-causing species in the polymerized latex. Furthermore, it is preferred in embodiments that the compound that scavenges odor-causing species is of sufficient size or properties that it can be easily mixed with and then removed from the latex after the polymerization is completed, and before the latex is further processed for its desired use.

Examples of suitable odor-scavenging compounds include, but are not limited to, bismuth compounds, and preferably organic or inorganic salts including bismuth. Examples of such compounds include, but are not limited to, bismuth salicylate, bismuth subsalicylate, bismuth subgallate, bismuth benzoate, bismuth salicylate basic, 4H-1,3,2-Benzodioxabismin-4-one, 7-amino-2-hydroxy-(9CI), 6H-1,3,5,2,4-Benzotrioxadibismocin-6-one, 2,4,9-trihydroxy-(9CI), Bismuth-β-resorcylate, 4H-1,3,2-Benzodioxabismin-4-one, 2,7-dihydroxy-(9CI), bismuth subgallate hydrate, and combinations thereof. Preferably, the odor-scavenging compound is bismuth subsalicylate or bismuth subgallate, and more preferably bismuth subsalicylate. Bismuth subsalicylate is also referred to as basic bismuth salicylate or bismuth oxysalicylate, and has the formula:

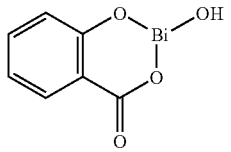

The odor-scavenging compound is preferably used in the form of a wet cake, or in the form of a solution or colloidal suspension. These forms are preferred over dry powders because, for example, it is generally difficult to wet such dry powder compounds such that they can be suitable dispersed in the emulsion latex to effectively scavenge the odor-causing compounds. When in the form of a wet cake, solution, suspension or the like, it is preferred that the liquid medium employed be water.

Although any suitable odor-scavenging compound can be used, it is preferred that the compound be able to be effectively removed from the latex polymer emulsion after having been in contact with the emulsion for a period of time. Thus, for example, where the emulsion polymerization results in particles having an average particle size of less than 1 micron, it is preferred that the odor-scavenging compound be in the form of particles or crystals having a size greater than about 1 micron. This allows for the polymerization medium to be filtered removing the odor-scavenging compound and the scavenged odor-causing species. Of course, it will be appreciated that when the average particle size of the polymerized material is greater than or less than one micron, the odor-scavenging compound can then be suitably selected to have greater or lesser particle sizes to allow for effective removal. Other methods can also be used to remove the odor-scavenging compound from the polymerization medium, although filtration is preferred in terms of time, cost and ease of use.

Also in terms of structure and properties, it is preferred that the selected odor-scavenging compound be capable of removing some or all of the odor-causing species that are present in or generated by the emulsion polymerization process. Thus, for example, it is preferred that the odor-scavenging compound be capable of removing sulfur-containing compounds produced by compounds such as ammonium persulfate or other similar materials and organic compounds such as residual monomer and compounds that are products or byproducts of dodecanethiol or other similar materials.

The odor-scavenging compound can be added to the emulsion polymerization medium after the polymerization is completed. Preferably, the odor-scavenging compound can be added to the emulsion polymerization medium after the polymerization is completed and after the medium has been reduced from its reaction temperature to a lower (i.e., room) temperature. Where optional washing or separation steps are used to remove reactants or other materials from the formed latex, the odor-scavenging compound can be added before, during or after such optional steps.

When added, the odor-scavenging compound is added to the emulsion polymer in an amount of from about 0.1 to about 20 percent by weight of the entire reaction medium. Preferably, odor-scavenging compound is added to the reaction medium in an amount of from about 0.5 or from about 1 to about 15 percent by weight, more preferably from about 2 to about 10 percent by weight, or most preferably from about 2.5 to about 5 percent by weight.

The polymer selected for the process of the present invention can be prepared by emulsion polymerization methods, and the monomers utilized in such processes include, for example, styrene, acrylates, methacrylates, butadiene, isoprene, acrylic acid, methacrylic acid, itaconic acid, beta carboxy ethyl acrylate, acrylonitrile, and the like. Known chain transfer agents, for example dodecanethiol, from, for example, about 0.1 to about 10 percent, or carbon tetrabromide in effective amounts, such as for example from about 0.1 to about 10 percent, can also be utilized to control the molecular weight properties of the polymer when emulsion polymerization is selected. Other processes of obtaining polymer particles of from, for example, about 0.01 micron to about 2 microns can be selected from polymer microsuspension process, such as disclosed in U.S. Pat. No. 3,674,736, the disclosure of which is totally incorporated herein by reference; polymer solution microsuspension process, such as disclosed in U.S. Pat. No. 5,290,654, the disclosure of which is totally incorporated herein by reference, mechanical grinding processes, or other known processes. Also, the reactant initiators, chain transfer agents, and the like as disclosed in U.S. Pat. No. 922,437, and many of the Xerox patents mentioned herein, the disclosures of which are totally incorporated herein by reference, can be selected for the processes of the present invention. The emulsion polymerization process may be accomplished by a batch process (a process in which all the components to be employed are present in the polymerization medium at the start of the polymerization) or by continuous emulsification process. The monomer(s) can also be fed neat or as emulsions in water.

Emulsion polymerization is usually performed by heating, for example, at a temperature of from about 25 to about 120° C., and preferably from about 50 to about 95° C. and wherein for the reaction there is included initiators, such as azo polymerization initiators, with a solubility of greater than about, or about equal to 0.05 grams, and preferably about 0.5 grams per liter of monomers at 25° C. in the monomer mixture, or water, and with an appropriate half life at the temperature of polymerization. Appropriate half life refers for example, to a half life of about 1 to 4 hours. Typical examples of such initiators, are azocumene, 2,2'-azobis(isobutyronitrile), 2,2'-azobis(2-methyl)butanenitrile, 4,4'-azobis(4-cyanovaleric acid), 2,2'-azobis>2-methyl-N-(2-hydroxyethyl)!-propionamide, 2,2'-azobis>2-methyl-N-1,1-bis(hydroxymethyl)-2-(hydroxyethyl)!-propionamide, and 2-(t-butylazo)-2-cyanopropane. Other soluble non-azo initiators with an appropriate half life may also be used, including, among others, benzoyl peroxide, lauroyl peroxide, molecular hydrogen, and sodium, potassium or ammonium persulfates. An effective concentration of the initiator generally employed is, for example, from about 0.05 to about 10 percent by weight, and preferably from about 0.2 to about 5 percent by weight of monomers used to prepare the polymer, or copolymer resin. Redox initiator systems can also be used, such as redox pairs like ammonium persulphate/sodium metabisulphite. An effective concentration of the redox initiator generally employed is, for example, from about 0.01 to about 10 percent by weight, and preferably from about 0.05 to about 3 percent by weight of monomers in the reaction mixture.

To ensure maximum catalyst activity the emulsion polymerizations should preferably be accomplished in the substantial absence of oxygen under an inert atmosphere, such as nitrogen, argon or other non-oxidizing gas.

The present disclosure is directed to processes for the preparation of toner compositions, which processes generally comprises blending an aqueous colorant comprised of a dispersion preferably containing a pigment such as carbon black, phthalocyanine, cyan, magenta, yellow, red, blue, green, and more specifically quinacridone or RHODAMINE B™ type dispersed with an anionic surfactant, such as sodium dodecylbenzene sulfonate, with a latex emulsion prepared as illustrated herein, and wherein the latex monomers are selected for example, from the group consisting of styrene, butadiene, acrylates, methacrylates, acrylonitrile, acrylic acid, methacrylic acid, and the like, adding additional components such as waxes and/or charge control agents, then finally the addition of an aggregating agent such as polyaluminum chloride, heating the resulting flocculent mixture at a temperature below or about equal to the Tg of the polymer or resin formed in the latex, ranging for example, from about 30° C. to about 65° C. for an effective length of time of for example 1.5 hour to about 4 hours to form toner sized aggregates; and subsequently heating the aggregates, preferably suspension at a temperature at or above the Tg of the latex polymer, for example from about 60 to about 100° C. to coalesce the aggregate slurry and provide toner particles; and cooling, isolating the toner product by filtration, and thereafter washing and drying in an oven, fluid bed dryer, freeze dryer, or spray dryer; whereby toner particles comprised of polymer, or resin, colorant, and optional additives are obtained.

Other processes provide for the preparation of polymer containing latexes and which latexes can be selected for emulsion/aggregation/coalescence processes illustrated in the appropriate patents recited herein, wherein the emulsion process utilizes the odor-scavenging compound described above, and there is formed a polymer latex.

A direct toner preparative process is also provided, which comprises blending an aqueous colorant dispersion containing for example a pigment, such as magenta, yellow, cyan, red, green, and more specifically HELIOGEN BLUE™ or HOSTAPERM PINK™and an aggregating agent such as polyaluminum chloride, and a latex emulsion generated with an odor-scavenging compound as described herein, and wherein the latex polymer is derived from emulsion polymerization of monomers selected for example, from the group consisting of styrene, acrylates, methacrylates, acrylonitrile, butadiene, acrylic acid, methacrylic acid, and the like, thereby resulting in the flocculation of the polymer particles with the pigment particles and optional additives; and which flocculent mixture, on further stirring at a temperature of from about 35° C. to about 60° C., results in the formation of toner sized aggregates having an aggregate size of from about 2 microns to about 20 microns in volume average diameter as measured by the Coulter Counter (Microsizer II) and a particle size distribution of about 1.15 to about 1.35; thereafter, heating the aggregate suspension at from about 70° C. to about 95° C. to form toner particles; followed by cooling, and isolation by known methods, such as filtration, washing, and drying in an oven, or the like.

Another process for making toner compositions comprising polymer and colorant according to this disclosure comprises (i) blending an aqueous colorant dispersion containing an ionic surfactant with an emulsion latex containing resin generated as indicated herein and formed using an odor-scavenging compound, and a surfactant with a charge polarity opposite to that of ionic surfactant in the colorant dispersion; (ii) heating the resulting mixture at a temperature of about 25° C. to about 1° C. below the Tg (glass transition temperature) of the latex resin, or polymer to form toner sized aggregates; (iii) subsequently heating the resulting aggregate suspension to a temperature of about 75° C. to about 120° C. to effect coalescence or fusion of the components of aggregates to enable formation of integral toner particles comprised of polymer, and colorant; and (iv) isolating the toner product by for example filtration, followed by washing and drying.

Illustrative examples of specific latex monomers, in suitable amounts, for example, from about 40 to about 100 percent by weight, and more preferably is from about 60 to about 100 percent, or parts are alkyl acrylates, alkyl methacrylates, styrenes, acrylonitriles, dienes, vinyl esters, and acid or basic olefinic monomers, and generally acrylates, methacrylates, especially styrene acrylates, and styrene methacrylates. Examples of alkyl acrylates are $C_1$ to $C_{10}$ alkyl acrylates; of alkyl methacrylates are $C_1$ to $C_{10}$ alkyl methacrylates; of styrenes are styrene, a-methyl styrene, and t-butyl styrene; of acrylonitriles are acrylonitrile or methacrylonitrile; of dienes are butadiene or isoprene; of vinyl esters are vinyl acetate or vinyl butyrate; of acid olefinic monomers are acrylic acid, methacrylic acid, fumaric acid, maleic acid, itaconic acid; and of basic olefinic monomers are acrylamide, methacrylamide, vinylpyridine, vinylpyrrolidone, or vinyl-N-methacrylpyridinium. Polymers generated from the monomers selected include poly(styrene-methyl methacrylate), poly(styrene-butyl methacrylate), poly(styrene-butyl acrylate), poly(styrene-butadiene), poly(methyl methacrylate-butyl acrylate), poly (butyl methacrylate-butyl acrylate), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-butyl acrylate-acrylic acid), poly (styrene-butadiene-acrylic acid), poly(styrene-isoprene-acrylic acid), poly(styrene-butyl methacrylate-acrylic acid), poly(butyl methacrylate-acrylic acid), poly(styrene-butyl acrylate-acrylonitrile-acrylic acid), poly(methyl methacrylate-butyl acrylate-acrylic acid), poly(acrylonitrile-butyl acrylate-acrylic acid), and the like. With the processes of the present disclosure, monomers as illustrated herein are selected and preferably monomers of methyl methacylate, ethyl methacrylate, n-butyl methacrylate, styrene, and a-methyl styrene. Polymers generated from the monomers selected include poly(styrene-butyl methacrylate), poly(styrene-butyl acrylate), poly(methyl methacrylate-butyl acrylate), poly(methyl methacrylate-butyl acrylate-acrylic acid), and poly(styrene-butyl acrylate-acrylic acid).

The latex polymer is generally present in the toner compositions in various suitable amounts, such as from about 75 weight percent to about 98 weight percent of the toner. The latex resin size suitable for the processes of the present disclosure can be, for example, from about 0.05 micron to about 1 micron in volume average diameter as measured by the Brookhaven nanosize particle analyzer.

Various known colorants, such as pigments, dyes, or mixtures thereof, present in the toner in an effective amount of, for example, from about 1 to about 20 percent by weight of toner, and preferably in an amount of from about 3 to about 12 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, CX6369™; Bayer magnetites, BAYFERROX 8600™, 8610™; Northern Pigments magnetites, NP-604™, NP-608™; Magnox magnetites TMB-100™, or TMB-104198; and the like, and wherein the magnetites, especially when present as the only colorant component can be selected in an amount of up to about 70 weight percent. As colorants there can be selected cyan, magenta, yellow, red, green, brown, blue or mixtures thereof. Specific examples of colorants include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK® from Hoechst, and CINQUASIA MAGENTA™ available from E.I. DuPont de Nemours & Company, and the like. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used as pigments include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present disclosure. Colorants for use herein can include one or more pigments, one or more dyes, mixtures of pigment and dyes, mixtures of pigments, mixtures of dyes, and the like.

The toner may also include known charge additives in effective suitable amounts of, for example, from 0.1 to 5 weight percent such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge enhancing additives like aluminum complexes, and the like.

Surfactants in effective amounts of, for example, 0.01 to about 10 weight percent of the reaction mixture in embodiments include, for example, nonionic surfactants, and which nonionic surfactants are contained in the latex emulsion during emulsion polymerization, examples of which are surfactants such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210 ™, ANTAROX 890™ and ANTAROX 897™; anionic surfactants such as for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, Biosoft D-40™ obtained from Stepan, and the like, in effective amounts of for example, from about 0.01 to about 10 percent by weight. Examples of the colorant dispersion cationic surfactants are dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, MIAPOL™ and ALKAQUAT™ available from Alkaril Chemical Company, SANIZOL™ (benzalkonium chloride), available from Kao Chemicals, and the like, in effective amounts of for example from about 0.01 percent to about 10 percent by weight. Preferably, the molar ratio of the cationic surfactant used for flocculation to the anionic surfactant used in the latex preparation is in the range of from about 0.5 to about 4.

Examples of surfactants which can be added to the aggregates before coalescence is initiated are anionic surfactants such as sodium dodecylbenzene sulfonate, sodium dodecylnaphthalene sulfate, dialkyl benzenealkyl, sulfates and sulfonates, abitic acid, available from Aldrich, NEOGEN R™, NEOGEN SC™ obtained from Kao, Biosoft D-40™ obtained from Stepan, and the like; nonionic surfactants such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™and ANTAROX 897™. An effective amount of the anionic or nonionic surfactant utilized in the coalescence to primarily stabilize the aggregate size from further growth, or to minimize growth, with temperature is, for example, from about 0.01 to about 10 percent by weight, and preferably from about 0.5 to about 5 percent by weight of the reaction mixture.

Surface additives that can be added to the toner compositions preferably after washing or drying include as indicated herein, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate, titanias, silicas and coated silicas, like AEROSIL R972® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 5,002,846, 4,937,166 and 4,935,326, the disclosures of which are totally incorporated herein by reference, for example from about 2 percent toner concentration to about 8 percent toner concentration.

Imaging methods are also envisioned with the toners of the present invention, reference for example a number of the patents mentioned herein, and U.S. Pat. Nos. 4,265,660, 4,585,884, 4,584,253, and 4,563,408, the disclosures of which are totally incorporated herein by reference.

An example is set forth herein below and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Comparative Example 1

Preparation of Conventional Polymer Latex

A latex emulsion comprised of polymer particles derived from, or generated from the emulsion polymerization of styrene, butyl acrylate and acrylic acid is prepared as follows. Dodecanethiol is used as a chain transfer agent in an amount of 0.2 wt % (weight percent) based on the amount of total monomers used to prepare the copolymer resin (0.2 pph or 2,000 ppm of monomers). 432 grams of styrene, 108 grams of butyl acrylate, 16.2 grams of acrylic acid, 13 grams of Ammonium persulfate and 1.0 grams of dodecanethiol as the catalytic chain transfer agent are mixed with 810 grams of deionized water in which 16.5 grams of sodium dodecyl benzene sulfonate anionic surfactant, Biosoft D-40™ (38% active) is dissolved. The resulting mixture is stirred at room temperature of about 25° C. under a nitrogen atmosphere for 60 minutes. Subsequently, the resulting mixture is stirred and heated to 80° C. at a rate of 1° C. per minute, and retained at this temperature for 6 hours. A nitrogen atmosphere is maintained in the flask throughout the course of the reaction. The resulting latex contains 60 percent of water and 40 percent of solids of the styrene-butyl acrylate-acrylic acid polymer 80/20/3 parts (by weight). The resulting latex polymer possesses a Mw of 21,500, a Mn of 6,000 as determined on a Waters GPC, and a mid-point Tg of 62.4° C. as measured on a Seiko DSC. The latex polymer, or latex resin possesses an average volume diameter of 190 nanometers as measured by light scattering technique on a Coulter N4 Plus Particle Sizer.

A sample of the thus-prepared latex is analyzed by a GC/MS to determine relative types and amounts of non-polymeric species present in the latex. These results are described below.

Example 1

Preparation of Polymer Latex

A portion of the formed latex emulsion of polymer particles prepared in Comparative Example 1 is used. After the latex formation process, and after the latex had cooled to room temperature, 2.5 percent by weight bismuth subsalicylate is added as an odor-scavenging compound. The mixture is mixed on a roll mill for one to four hours, removed and filtered.

After mixing of the materials is completed, the resultant emulsion is filtered through a 1 micron filter to remove the added bismuth subsalicylate and the scavenged odor-causing compounds.

A sample of the thus-prepared latex is analyzed by a GC/MS as in Comparative Example 1 to determine relative types and amounts of non-polymeric species present in the latex. This testing shows that the only non-polymeric materials present in the emulsion are 1-butanol, residual styrene monomer, and dodecanal.

In particular, GC/MS analysis of the latex of Comparative Example 1 revealed the presence of compounds such as 1-butanol, ethyl benzene, o-xylene, styrene, n-butyl acrylate, m-xylene and p-xylene, α-methylstyrene, cumene, propyl benzene, benzaldehyde, benzeneacetaldehyde, acetophenone and dodecanal. Additional levels of volatile compounds are trapped cryogenically in the latex of Comparative Example 1: butane, methanethiol, 2-methylbutane, pentane, carbon disulfide, ethanethiol, hexane, benzene, thiophene, heptane, methylcyclohexane, dimethyldisulfide, octane, dimethyltrisulfide, 4-ethyl-2-octene, cyclododecane, and dodecanethiol. Upon treatment with bismuth subsalicylate in Example 1, the volatiles are reduced in quantity and level with reduced levels of 1-butanol, styrene and dodecanal present.

Example 2

Preparation of Polymer Latex

A latex emulsion comprised of polymer particles derived from, or generated from the emulsion polymerization of styrene, butyl acrylate and acrylic acid is prepared as in Example 1, except that the amount of added bismuth subsalicylate is 10 weight percent. After polymerization and mixing of the materials is completed, the resultant emulsion is filtered through a 1 micron filter to remove the added bismuth subsalicylate and the scavenged odor-causing compounds.

A sample of the thus-prepared latex is analyzed by a GC/MS as in Comparative Example 1 to determine relative types and amounts of non-polymeric species present in the latex. This testing shows that the only non-polymeric materials present in the emulsion are 1-butanol, residual styrene monomer, and dodecanal, in amounts less than the amounts present in the latex of Example 1.

Comparison of the results of Comparative Example 1 and Examples 1 and 2 demonstrate that the addition of bismuth subsalicylate scavenges a majority of the non-polymeric compounds present in the latex emulsion, including many of the odor-causing substances otherwise present. Simple smelling of the latex emulsions shows that while the latex emulsion of Comparative Example 1 has a strong and objectionable acrid odor, the latex emulsions of Examples 1 and 2 do not have such an odor. The acrid odor is attributed to sulfur containing components, as well as monomer and other fractionated components.

Comparative Example 2

Preparation of an EA Toner

A latex emulsion prepared by the semicontinuous emulsion polymerization of styrene/butyl acrylate/acrylic acid, 76.5/24.5/3 parts (by weight) used as the core and shell resin. 251.0 grams of the above prepared latex emulsion and 62 gm (6%) of a Red 122 pigment dispersion containing 19% pigment and 1.65% anionic surfactant (sodium dodecylbenzenesulfonate) and 58 gm polyethylene wax containing 40% wax, 1.5% nonionic surfactant (sodium dodecylbenzenesulfonate) are simultaneously added to 430 milliliters of water with high shear stirring at 4,000 rpm for 2 minutes by means of a IKA-T50 homogenizer. The coagulant polyaluminum chloride dispersed in nitric acid (0.02 M) is added drop wise until incorporated and the slurry is mixed using high shear stirring for 20-30 minutes. The resulting mixture is then transferred to a 2 liter reaction vessel and heated at a temperature of 58° C. for 230 minutes until the mix aggregates and a shell is added. The particle size obtained is (volume average diameter) 6.0 microns with a GSD=1.23 as measured on the Coulter Counter. Subsequently, the mixture is heated to 96° C. and held there for a period of 4.5 hours before cooling down to room temperature, about 25° C. throughout, filtered, washed with water 3 times, and dried in a freeze dryer. The final toner product evidences a particle size of 5.95 microns in volume average diameter with a particle size distribution of 1.23 as measured on a Coulter Counter.

A sample of the thus-prepared toner is analyzed by a GC/MS as in Comparative Example 1 to determine relative types and amounts of non-polymeric species present in the latex. This testing shows that the non-polymeric materials present in the toner particles include 1-butanol, ethyl benzene, xylene, butyl ether, styrene and butyl acrylate monomers, alpha-methyl styrene cumene, propyl benzene, benzaldehyde, dodecane, and dodecanal. The toner is placed in glass scintillation vials, placed on a temperature controlled hotplate and qualitatively examined by a group of subjects (n=10) for objectionable odor. The toner is said to have an acrid, sulfur-like smell, found to be objectionable by the majority of the subjects.

Example 3

Preparation of an EA Toner

A toner composition is formed as in Comparative Example 2, except that the formed latex emulsion of polymer particles, after cooling, is treated with 2.5 percent by weight bismuth subsalicylate as an odor-scavenging compound. The mixture is mixed on a roll mill for one to four hours, removed and filtered. After mixing of the materials is completed, the resultant emulsion is filtered through a 1 micron filter to remove the added bismuth subsalicylate and the scavenged odor-causing compounds.

The toner is placed in glass scintillation vials, placed on a temperature controlled hotplate and qualitatively examined by a group of subjects (n=10) for objectionable odor. The toner is found not to have an acrid, sulfur-like smell, and is not found to be objectionable by the subjects.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A process for preparing a toner latex comprising:

polymerizing at least one monomer in the presence of an initiator to form a polymer emulsion; and adding an odor-scavenging bismuth compound to the formed polymer emulsion, wherein the odor-scavenging bismuth compound is bismuth subsalicylate.

2. A process in accordance with claim 1, further comprising reducing a temperature of the formed latex to about room temperature, prior to said adding.

3. A process in accordance with claim 1, wherein the odor-scavenging bismuth compound is added after the polymerization of said monomers has been terminated.

4. A process in accordance with claim 1, wherein the odor-scavenging bismuth compound is present in an amount of from about 0.1 to about 20 percent by weight.

5. A process in accordance with claim 1, further comprising removing the odor-scavenging bismuth compound from the formed latex.

6. A process in accordance with claim 5, wherein said removing comprises filtering the latex using a filter having a pore size of 1 micron or larger.

7. A process in accordance with claim 1, wherein the monomer is selected from the group consisting of alkyl acrylates, alkyl methacrylates, styrenes, acrylonitriles, dienes, vinyl esters, acid olefinic monomers, and basic olefinic monomers.

8. A process in accordance with claim 1, wherein the odor-scavenging bismuth compound removes odor-causing species from the latex.

9. A process for preparing a toner composition, comprising:

(i) aggregating a colorant dispersion with the latex of claim 1;

(ii) coalescing and fusing the aggregates generated; and (iii) optionally isolating, washing, and drying the toner.

10. A process in accordance with claim 9, wherein said aggregating is below about a polymer glass transition temperature of the latex, the coalescing and fusing of said aggregates is above about the latex polymer glass transition temperature, and there results toner with a size of from about 2 to about 20 microns in volume average diameter.

11. A process in accordance with claim 9, wherein the colorant is selected from the group consisting of a pigment, a dye, and mixtures thereof.

12. A process in accordance with claim 9, wherein the toner comprises toner particles having an average volume diameter of from about 2 to about 10 microns, and a particle size distribution of from about 1.10 to about 1.35.

13. A developer comprising: the toner composition of claim 9, and a carrier.

14. An electrographic image development device, comprising the toner composition of claim 9.

15. An electrographic image development device, comprising the developer composition of claim 13.

* * * * *